United States Patent [19]

Dodich

[11] Patent Number: 5,031,681

[45] Date of Patent: Jul. 16, 1991

[54] TILT CONTROL FOR WINDOW BLINDS, AND METHOD OF MANUFACTURE

[75] Inventor: James Dodich, New Milford, N.J.

[73] Assignee: Levolor Corporation, Parsippany, N.J.

[21] Appl. No.: 451,413

[22] Filed: Dec. 15, 1989

[51] Int. Cl.[5] ..... E06B 9/26

[52] U.S. Cl. ..... 160/176.1; 160/177

[58] Field of Search ..... 160/176.1, 177, 168.1, 160/166.1, 178.1

[56] References Cited

U.S. PATENT DOCUMENTS

| | | | |
|---|---|---|---|
| 3,156,295 | 11/1964 | Vecchiarelli et al. . | |
| 3,581,798 | 6/1971 | Malamed . | |
| 3,605,852 | 9/1971 | Vecchiarelli | 160/176.1 X |
| 3,828,838 | 8/1974 | Anderle et al. | 160/176.1 |
| 3,918,513 | 11/1975 | Englund et al. | 160/176.1 |
| 4,143,699 | 3/1979 | Marotto | 160/176.1 |
| 4,237,957 | 12/1980 | Hensel | 160/178.1 |
| 4,406,319 | 9/1983 | McNiel et al. | 160/177 |
| 4,572,267 | 2/1986 | Stein et al. | 160/176.1 |
| 4,676,292 | 6/1987 | Valle et al. | 160/177 X |

*Primary Examiner*—David M. Purol

*Attorney, Agent, or Firm*—Skjerven, Morrill, MacPherson, Franklin & Friel

[57] ABSTRACT

A tilt control assembly for window blinds is provided. The window blind includes a tilt control rod rotatably mounted in a channel for placement in proximity to an elevated location adjacent a window. The stop bracket which includes a stop structure is nonrotatably disposed in the channel in proximity to the tilt control rod. A pair of tilt control discs of substantially identical external configuration are nonrotatably mounted on the tilt control rod. The external configuration of each tilt control disc defines a nontangentially aligned stop surface for engaging the stop bracket. Each tilt control disc includes a noncircular mounting aperture generally conforming to the cross-sectional shape of the tilt control rod. The angular alignment of the noncircular portion of the mounting aperture to the stop surface of each tilt control disc is selected to effectively define the angular alignment of the stop surface to the tilt control rod. A pair of the discs are disposed with the respective stop surfaces facing one another but angularly separated to define the ranges of rotational movement of the tilt control rod.

8 Claims, 3 Drawing Sheets

TILT CONTROL FOR WINDOW BLINDS, AND METHOD OF MANUFACTURE

BACKGROUND OF THE INVENTION

Window blinds comprise a plurality of parallel slats that typically are formed from metal, plastic or wood. Most metal blinds slats are curved from side to side to define a convex top surface and a concave bottom surface. The slats are supported in a substantially horizontal array by flexible vertically aligned ladders. Each ladder comprises an elongated flexible runner and a plurality of transverse supports. The ladders are interlaced with the slats of the window blinds such that the runners are disposed on opposite respective sides of the array of slats, and such that each respective slat is supported by one transverse support of each ladder. The runners of each ladder extend upwardly beyond the horizontal array of slats and into a channel.

A tilt control rod is rotatably mounted in the channel of the prior art window blinds. The tilt control rod includes drums mounted thereon at locations generally in line with the ladders of the window blind. The runners of each ladder extend into the channel and are wrapped in opposite directions around the drum. With this construction, rotation of the tilt control rod about its axis causes a corresponding rotation of the drums mounted thereto and associated longitudinal movement of the ladder runners mounted to each drum. In particular, rotation of the tilt control rod causes one runner in each ladder to move upwardly while the other moves downwardly. This relative shifting of the runners causes the angular alignment of the transverse supports in each ladder to change, thereby causing the slats resting on the transverse supports to rotate in unison about their respective longitudinal axes.

The prior art window blinds further include a tilt control mechanism mounted in the channel. The typical prior art tilt control mechanism includes a gear mounted to the tilt control rod and a second gear engageable therewith and operatively connected to a tilt control actuator. For example, a worm gear may be engageable with the gear on the tilt control rod. The worm gear may be connected to a wand extending to an elevation that can be conveniently reached by an individual desiring to adjust the tilt of the blinds.

In theory, the slats of the window blind can be tilted through an angle approaching 180 degrees. In particular, the slats may be rotated almost 90 degrees in one direction from the horizontal alignment such that the top or convex surface of each slat is facing into the room in which the blinds are mounted. Alternatively, the blinds can be rotated almost 90 degrees in an opposite direction from their horizontal alignment such that the bottom or concave surface of each slat is facing generally inwardly. In most instances, the construction of the ladders and the interference of adjacent slats will define a limit to the amount of tilting that can take place. However, excessive tilting of the slats conceivably could cause a jam within the prior art blinds. As a result, many prior art blinds include means for positively controlling the amount of tilt. Additionally, many architectural applications of window blinds specify controls on the tilt of blinds to provide a more uniform exterior appearance for a building, and to control the lines of vision from a building and/or the alignment of light directed into a building. For example, an architect may specify that window blinds be adjustable such that only the convex top surface of each slat is viewable from the exterior of the building. Similarly, an architect may specify that the slat alignments limit vision of unsightly roadways or parking lots in proximity to the building in which the prior art blinds are disposed. In some instances, the range of acceptable blind tilts may vary from one floor of the building to the next. Architects may require slat tilt limits to be controlled within a few degrees in each rotational direction.

The prior art window blinds control the amount of tilt by nonrotatably mounting a tilt control disc to the rotatable tilt control rod in the channel. A typical prior art tilt control disc is illustrated in FIG. 1. More particularly, a prior art window blind 10 includes a tilt control rod 12 of non-round cross-section rotatably mounted in a channel 14. The channel 14 is mountable adjacent the top of a window (not shown). A clip 16 is slid over the tilt control rod 12 and into the channel 14, and is frictionally retained in the channel 14. The clip 16 is stamped and formed to include a rotational stop 18 and a deformable longitudinal stop 19. The prior art tilt control disc is identified by the numeral 20 and includes a non-round central aperture 22 conforming to the non-round cross-sectional shape of the tilt control rod 12. The prior art tilt control disc 20 is slid longitudinally over the tilt control rod 12 and into proximity to the clip 16. The longitudinal stop 19 is deformed toward the tilt control rod 12 to retain the tilt control disc 20 longitudinally adjacent to the clip 16. The prior art tilt control disc 20 is cut to include a pair of angularly aligned edges 24 and 26 that are disposed and dimensioned to engage the rotational stop structure 18 within the channel 14 of the prior art blinds 10. The engagement between either of the edges 24 and 26 of the prior art tilt control disc 20 and the rotational stop structure 18 within the channel 14 prevents further rotation of the tilt control rod 12. Thus, the surfaces 24 and 26 of the prior art tilt control disc 20 can be oriented relative to the alignment of the noncircular aperture 22 therein and relative to one another to positively control the range of tilt adjustments to the prior art blind 10.

Although the prior art tilt control discs 20 have worked adequately, they have required a slow labor-intensive manufacturing process. In particular, the prior art tilt control discs 20 have been manufactured by first providing a circular washer-like disc blank having a noncircular mounting aperture extending therethrough. The circumferences of these prior art disc blanks have then manually been presented to an appropriate cutting apparatus, such as a "nibbler" which shears through the metal of the prior art disc blank to define the surfaces 24 and 26 and a reduced radius portion therebetween. The prior art disc blank generally must be repositioned several times to remove the required portions of the blank. To accurately control the range of tilts, these linear stop surfaces 24 and 26 must be accurately positioned and aligned relative to the noncircular mounting aperture 22 in the center of the disc 20 and relative to one another. This slow labor-intensive manufacturing process has added significantly to the manufacturing time and cost for the prior art blinds. Furthermore, the slow labor-intensive manufacturing process has been difficult to accurately monitor, thereby creating a significant possibility of variance from the specified configuration. Stamp forming generally is not an option because the wide range of specified tilts would require a large number of expensive stamping dies. Assembly of the prior art tilt control has been awkward and slow, with corresponding cost penalties. In particular, the clip 16 is difficult to slide into the channel 14, and assemblers frequently receive injuries on metal edges. The prior art tilt control has been even more difficult to disassemble to attend to repairs or maintenance as needed.

In view of the above, it is an object of the subject invention to provide a tilt control assembly for accurately controlling the range of tilt of the slats of window blinds.

It is another object of the subject invention to provide an efficient process for manufacturing and assembling tilt control assemblies for controlling the range of tilt of the slats of window blinds.

SUMMARY OF THE INVENTION

The subject invention is directed to a tilt control assembly for limiting the range of tilt adjustment for window blinds. The tilt control assembly of the subject invention comprises first and second tilt control discs. The first and second tilt control discs each include mounting means for permitting nonrotatably mounting of each respective disc to the tilt control rod of a window blind. The mounting means may comprise a noncircular aperture extending through each tilt control disc, with the shape of the noncircular aperture conforming to the cross-sectional shape of the tilt control rod.

The assembly further includes a stop structure which can be urged laterally into the channel at a selected longitudinal position to control rotational and longitudinal movement of the discs.

Each tilt control disc includes an outwardly disposed nontangentially aligned stop surface. The stop surface of each tilt control disc may be generally radially aligned on the disc. The stop surface is dimensioned to engage the nonrotatable stop structure in the channel of the window blind to limit the rotational movement of the tilt control disc and the tilt control rod to which the disc is mounted. The alignment of the tilt control rod at which its rotation is stopped will be determined by the angular alignment of the stop surface on the disc to the mounting means formed in the disc. The first and second tilt control discs are similarly constructed, but are provided with oppositely facing stop surfaces. In this manner, the first and second tilt control discs will define opposite extremes of rotational motion for the tilt control rod in the window blinds. The first and second stop surfaces are aligned relative to the mounting apertures of the respective discs to provide the specified range of rotational motion of the tilt control rod, and accordingly the specified range of tilting for the slats of the window blind.

The tilt control means of the subject invention may be manufactured by first stamp forming a plurality of substantially identical tilt control discs. Each disc may have a substantially continuous central portion and an outwardly disposed nontangentially aligned stop surface. The stop surface may be generally radially aligned, or may be aligned along a generally chordal line extending across the disc. At this point in the manufacturing process, there may be no mounting apertures or other mounting means formed in the disc.

The manufacturing process of the subject invention may proceed by stamping mounting means into the tilt control disc. The mounting means preferably is nonsymmetrical to enable a specific nonrotatable alignment of the tilt control disc on the tilt control rod. The mounting means may be a noncircular mounting aperture extending through the disc, such as a generally D-shaped mounting aperture formed therethrough. The angular alignment of the mounting means to the stop surface is selected to define a particular angular stop position of the tilt control disc in the channel of the window blind.

In a particularly preferred manufacturing process, the disc is positioned in a stamp press having a punch die conforming to the noncircular cross-sectional shape of the tilt control rod. The tilt control disc is angularly oriented in the stamp press for achieving the selected angular orientation of the stop surface to the noncircular mounting aperture. This angular orientation may be achieved by positioning the stop surface of the tilt control disc against an appropriate fixture on the anvil of the stamp press. The second tilt control disc is manufactured in substantially the same manner, but may be placed in the stamp press at a different angular or rotational position. This different angular or rotational position may be achieved by merely adjusting the fixturing means on the anvil of the stamp press, or by appropriately adjusting the punch in the stamp press.

As an alternative to the above described process, the circular blanks may all initially be stamped with the noncircular mounting aperture. The blanks may then be disposed in a stamping press for stamping the stop surface. The noncircular mounting means may be angularly aligned in the stamp press to achieve the specified angular alignment between the noncircular mounting means and the stop surface.

The first and second tilt control discs are mounted to the tilt control rod with their respective stop surfaces facing in opposite directions. In this manner, the oppositely facing stop surfaces will define the extreme ranges of rotational movement for the tilt control rod.

It should be emphasized that the tilt control described above and described in greater detail below enables precise control of the tilt of the window blind slats while simultaneously offering very significant manufacturing efficiencies. In particular, the rotational orientation of the mounting aperture to the stop surface can readily be achieved with fairly simple fixturing in the stamp press. The die used for each tilt control disc is exactly the same, with only the angular orientation of the punch die to the stop surface or mounting aperture being altered in accordance with the tilt specifications for the window blinds. The tilt control discs described and illustrated herein avoid the need to carefully customize the position and shape of the stop surfaces for each tilt specification. Rather, either the stop surface or the mounting aperture may be identically stamped or molded for all tilt control discs prior to forming the other tilt control (e.g. mounting aperture or stop surface). Furthermore, the stop bracket against which the discs abut is much easier to install and remove.

DETAILED DESCRIPTION OF THE PREFERRED EMBODIMENTS

Figure 1:
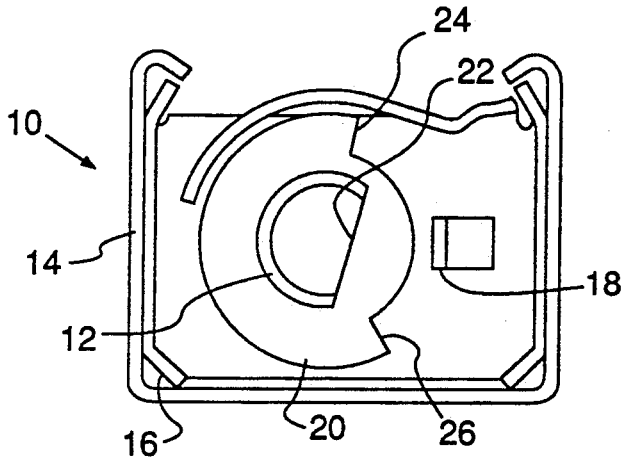
FIG. 1 (PRIOR ART)
FIG. 1 is a top plan view of a prior art tilt control assembly.
Figure 2:
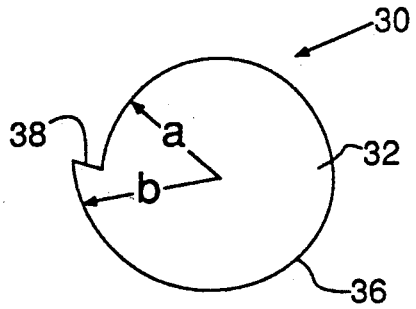
FIG. 2 is a top plan view of the tilt control disc of the subject invention prior to forming the mounting aperture therein.
Figure 3:
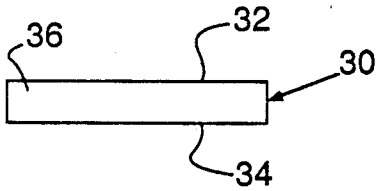
FIG. 3 is a side elevational view of the tilt control disc shown in FIG. 2.

The tilt control disc of the subject invention is formed from a rigid blank 30 as illustrated in FIGS. 2 and 3. The blank 30 preferably is formed from a metallic material with opposed planar substantially parallel surfaces 32 and 34. A side edge 36 extends between and connects the surfaces 32 and 34 of the blank 30. The side edge 36 is generally helically shaped, as shown in FIG. 2, with a minor radius "a" and a major radius "b". A stop surface 38 is defined in the side edge 36 and extends generally in a nontangential direction between the portion of the blank 30 defining the minor radius "a" and the portion thereof defining the major radius "b". The stop surface 38 is dimensioned to permit secure engagement with a stop structure comparable to the stop structure 18 on the prior art blind 10. As will be explained further below, the minor radius "b" is sufficiently small to avoid engagement with the stop structure nonrotatably mounted in the channel of the blind.

Figure 4:
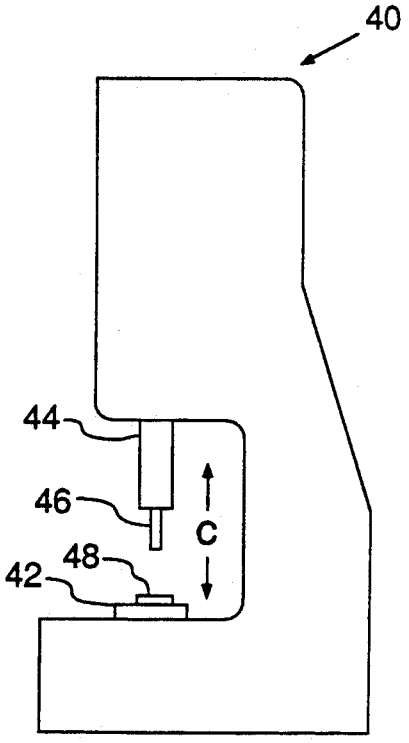
FIG. 4 is a schematic view of a stamp press for performing the final manufacturing step on the tilt control disc of the subject invention.

The blank 30 of FIGS. 2 and 3 is presented to a stamp press which is illustrated schematically in FIG. 4 and is identified generally by the numeral 40. The stamp press 40 includes an anvil 42 and a ram 44 which is reciprocally movable relative to the anvil 42. A punch die 46 is mounted to the ram 44 and reciprocally moves with the ram 44 selectively toward and away from the anvil 42 as indicated generally by arrow "c". The anvil 42 is provided with fixturing means 48 which enables the blank 30 to be placed on the anvil 42 in a particular specified angular orientation relative to the punch die 46. The anvil 42 with the fixturing means thereon may be rotatable about an axis extending along the direction of movement of the ram 44. Alternatively, the punch die 46 may be rotatably adjustable relative to the ram 44. The rotatable adjustment of either the fixture 48 or the punch die 46 will enable the precise angular positioning of the punch die relative to the blank 30, and in particular relative to the angular position of the stop surface 38. In other embodiments, the stamp press 40 may be operative to stamp a stop surface 38 at a particular angular alignment to the mounting aperture previously disposed in the blank.

Figure 5A:
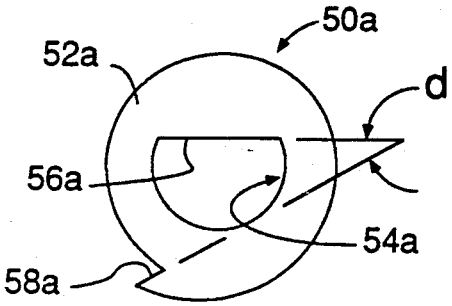
FIGS. 5a-5c are top plan views of tilt control discs with different angular alignments of the mounting apertures to the stop surfaces.
Figure 5B:
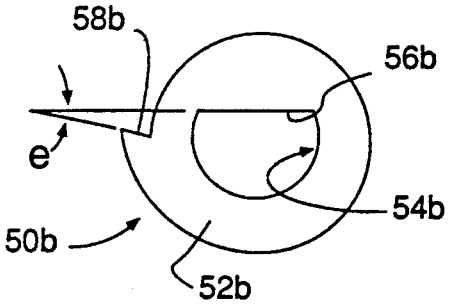
Figure 5C:
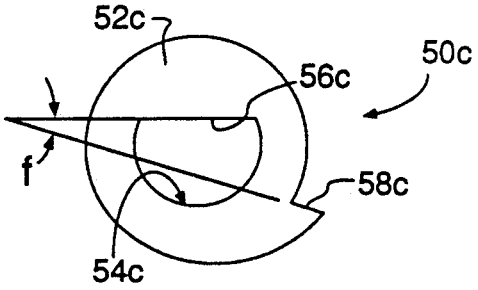

The manufacturing processes performed on the blank 30 by the stamp press 40 enables the production of a tilt control disc 50a, 50b, or 50c, as shown respectively in FIGS. 5a-5c. More particularly, with reference to FIG. 5a, the tilt control disc 50a has a top surface 52a of substantially the same external configuration as the blank 30. However, the punch die 46 was operative to stamp a noncircular mounting aperture 54a entirely through the tilt control disc 50a. More particularly, the noncircular mounting aperture 54a is defined in part by a linear internal edge 56a. As shown in FIG. 5a, the previously formed stop surface 58a of the tilt control disc 50a is angularly aligned to the linear surface 56a of the mounting aperture 54a to define an angle "d" which is selected and accurately controlled by the adjustments to the fixturing means 48 on the stamp press 40 as shown in FIG. 4 and as described above.

FIG. 5b shows a tilt control disc 50b which is formed from a blank 30 but which was stamped such that the linear edge 56b of the mounting aperture 54b therein defines an angle "e" relative to the stop surface 58b.

A third tilt control disc 50c is shown in FIG. 5c and includes a noncircular mounting aperture 54c having a linear internal edge 56c which is aligned at an angle "f" to the stop surface 58c.

It should be emphasized that the tilt control discs 50a-c all are formed from identical blanks 30 as depicted in FIG. 2. The differences between the angular alignments of the stop surfaces 58a-c and the linear edges 56a-c of the respective noncircular mounting apertures 54a-c is achieved by the relative angular alignment of the anvil fixturing means 48 to the punch die 46. Any of the tilt control discs 50a-c can be manufactured to meet a precise specified tilt control angle. However, in most instances a large number of tilt control discs will be manufactured in sets at about 5° or 10° increments for subsequent assembly as explained herein.

Figure 6:
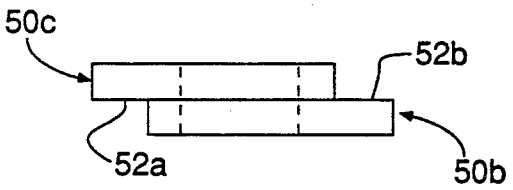
FIG. 6 is a side elevational view of a pair of mounting discs mounted in abutting face-to-face relationship.

A pair of tilt control discs 50a and 50b are used in combination with their respective top surfaces 52a and 52b being in opposed preferably face-to-face relationship with one another and with the mounting apertures 54a and 54b being in register with one another as shown in FIG. 6. The registration of the mounting apertures 54a and 54b enables the tilt control discs 50a and 50b to be slidably inserted over the noncircular cross section of the tilt control rod. In this orientation, as explained below, the respective stop surfaces will be facing one another, but will be separated angularly to define ranges of rotational movement of the tilt control rod.

The angular separation of the respective stop surfaces 58a and 58b depends upon the relative angular alignments of the stop surfaces 58a and 58b to the linear edges 56a and 56b of the respective tilt control discs 50a and 50b. As explained above, this angular alignment of the stop surfaces 58a-c and the linear edges 56a-c is controlled by adjusting the angular orientation of the blank 30 relative to the punch die 46 and/or fixture means 48 in the stamp press 40. Alternatively selected tilt control discs may merely be selected from previously manufactured sets at 5° or 10° increments.

Figure 9:
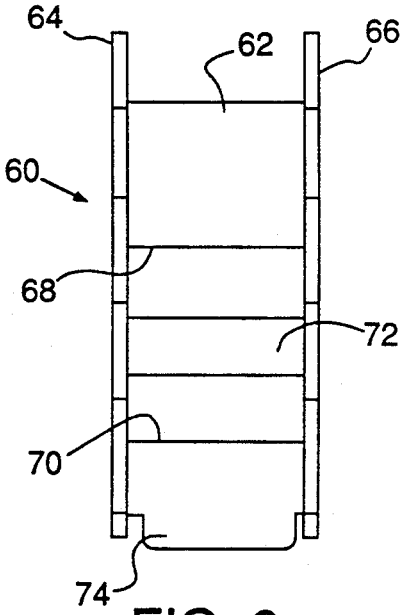
FIG. 9 is a bottom elevational view of the stop bracket shown in FIGS. 7 and 8.
Figure 7:
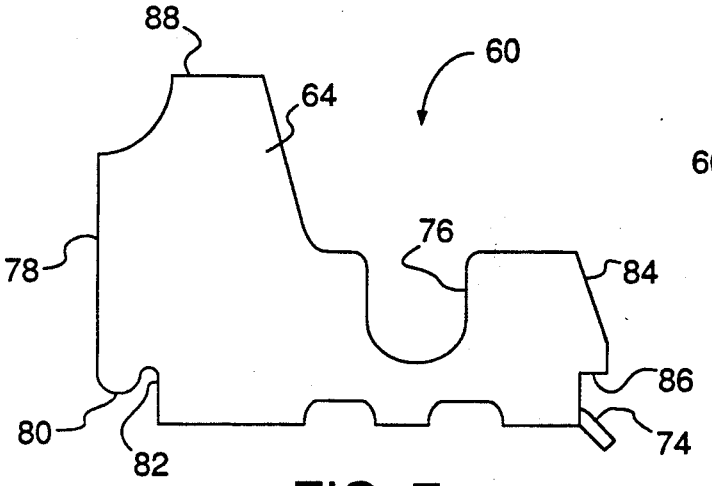
FIG. 7 is a front elevational view of the stop bracket of the subject invention.
Figure 8:
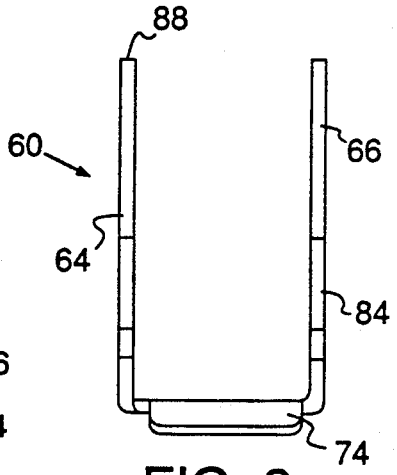
FIG. 8 is a side elevational view of the stop bracket of FIG. 7.

The tilt control discs described above and illustrated in FIGS. 2-6 are used in combination with a bracket 60 as illustrated in FIGS. 7-9. The bracket 60 is stamped and formed from a unitary piece of metal material and includes a base wall 62 and a pair of substantially parallel upstanding end walls 64 and 66 connected to and extending from the base wall 62. The base wall 62 is stamped to include a pair of spaced apart apertures 68 and 70 and a stop wall 72 disposed therebetween. The stop wall is disposed to engage the stop surfaces 58 on the tilt control discs, as explained further below. The base wall 62 further includes an engagement wall 74 disposed to engage a portion of a channel into which the bracket 60 is inserted as explained further herein.

The side walls 64 and 66 are substantially identical to one another. With reference to FIG. 7, the side wall 64 includes an arcuate notch 76 dimensioned to rotatably receive the tilt control rod of the window blind therein. The side wall 64 includes a side edge 78 for engaging a side wall of a channel into which the bracket 60 is inserted. The side edge 78 is defined in part by an arcuate pivoting edge 80 substantially adjacent the base wall 62 thereof. The arcuate pivoting edge 80 terminates in a notch 82 which is spaced from the side edge 78.

The portion of the end wall 64 opposite the side edge 78 thereof defines a ramping edge 84 which is angularly aligned to the side edge 78. The ramping edge 84 terminates in a locking edge 86 which is spaced from the base wall 62 by a distance substantially equal to the distance between the base wall 62 and the base of the notch 82. The locking edge 86 is generally aligned with but spaced from the engaging wall portion 74 of the base wall 62.

The end wall 64 further includes an edge 88 which defines the portion of the end wall 64 remote from the base wall 62. It will be understood that the end wall 66 depicted in FIGS. 8 and 9 include the same structural elements as the end wall 64.

Figure 10:
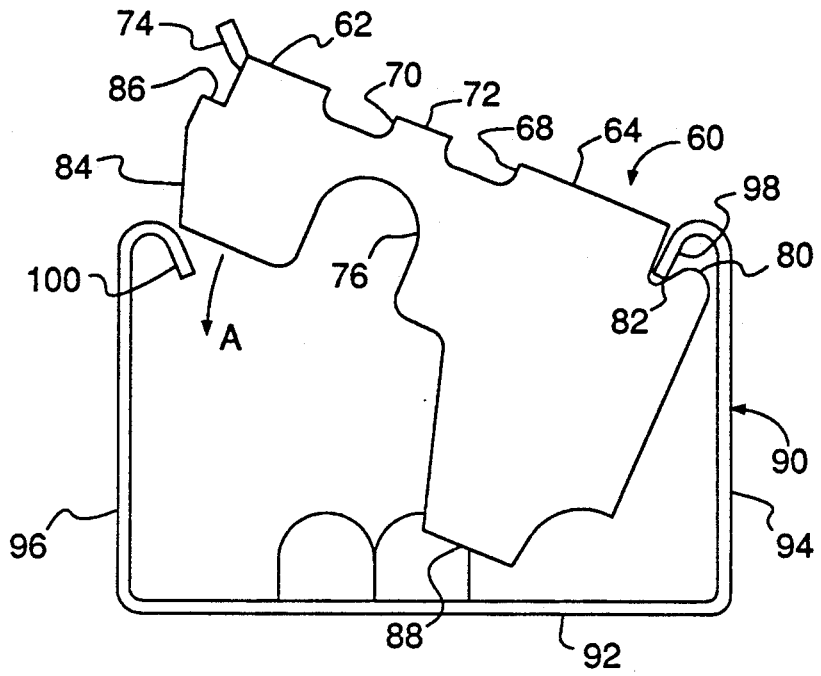
FIG. 10 is an elevational view of the stop bracket being rotated into the channel of a window blind.

The bracket 60 is selectively engageable in a window blind channel 90 at any location therealong. The channel 90 includes a bottom wall 92, a pair of opposed longitudinally extending side walls 94 and 96 and inwardly folded longitudinally extending lips 98 and 100. The bracket 60 is aligned with a selected location along the channel 90. The pivot edge 80 of the bracket 60 is then engaged intermediate the lip 98 and the side wall 94. In this condition, the lip 98 will be substantially engaged in the notch 82 of the end wall 64 of the bracket 60. The bracket 60 is then rotated about the pivot edge 80 in the direction indicated by arrow "A" as shown in FIG. 10. This rotational movement of the bracket 60 will cause the ramp edge 84 to engage the lip 100. Continued rotational movement in direction "A" will cause a deflection of the side wall 96 of the channel 90 relative to the bottom wall 92. Upon sufficient rotation, however, the locking edge 86 will pass beyond the lip 100 and the side wall 96 of the channel 90 will resiliently return to its undeflected condition. In this undeflected condition, the lip 100 will lockingly engage the locking edge 86 of the bracket 60. Additionally, in this locked condition, as shown most clearly in FIGS. 11 and 12, the base edge 88 will be disposed substantially adjacent to the bottom wall 92 of the channel 90. Additionally, the locking edge 86 and the engagement portion 74 of the base wall 62 will substantially trap the lip 100 therebetween preventing unintentional over-rotation of the bracket 60 or unintentional removal of the bracket 60 from the channel 90. Intentional removal of the bracket 60 from the channel 90 can be effected by merely deflecting the side walls 94 and 96 away from one another to enable the bracket 60 to be rotated about the pivot edge 80 in a direction opposite to the direction indicated by arrow "A" in FIG. 10.

Figure 11:
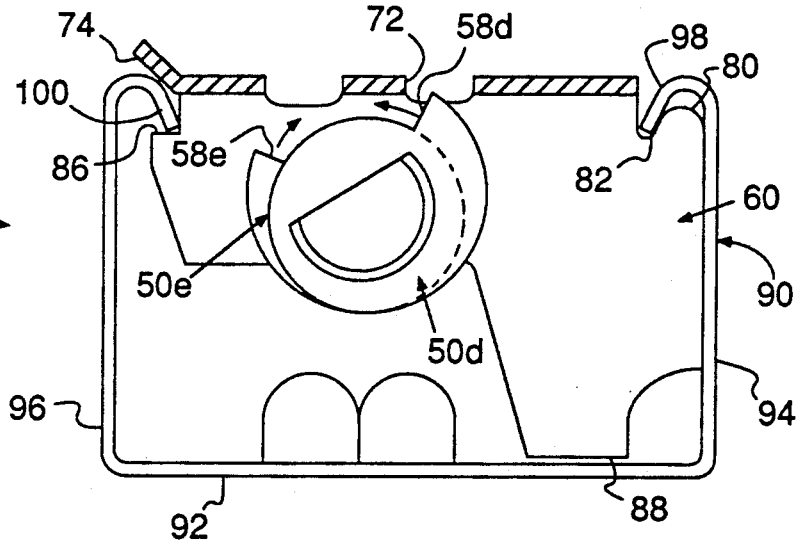
FIG. 11 is an elevational view of a pair of mounting discs mounted to a tilt control rod and disposed within a channel.
Figure 12:
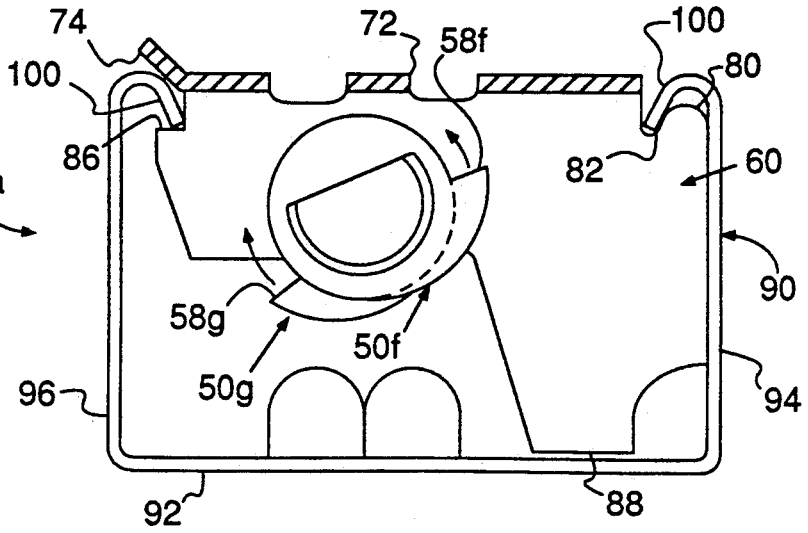
FIG. 12 is an elevational view similar to FIG. 11 but showing a different pair of tilt control discs.

With reference to FIGS. 11 and 12, the tilt control discs 50*a–c* and the bracket 60 are employed in a window blind assembly 104 having a channel 90 as explained above and a tilt control rod 106 of noncircular cross-sectional configuration. A selected pair of tilt control discs 50*d* and 50*e* are slid longitudinally onto the tilt control rod 106 such that the stop surfaces 58*d* and 58*e* are in opposed facing relationship to one another. The tilt control discs 50*d* and 50*e* are specially manufactured or selected from previously manufactured supplies to provide a desired range of tilt control movement for the window blinds 104. The tilt control discs 50*d* and 50*e* are slid along the tilt control rod to a selected longitudinal position thereon. The bracket 60 is then rotated into engagement with the channel 90 in substantially the manner depicted in FIG. 10 above. More particularly, the bracket 60 is positioned longitudinally along the channel 90 such that the tilt control discs 50*d* and 50*e* are disposed intermediate the end walls 64 and 66 of the bracket 60. Thus, the end walls 64 and 66 control the amount of longitudinal sliding of the tilt control discs 50*d* and 50*e* along the tilt control rod 106.

With further reference to FIGS. and 12, the stop surfaces 58*d* and 58*e* are selectively engageable with the stop wall 72 in the base 62 of the bracket 60. The engagement of either stop surface 58*d* or 58*e* will thus control the amount of rotational movement of the tilt control rod about its axis in either direction. Consequently, this engagement of the stop surfaces 58*d* or 58*e* will control the amount of tilt in the slats of the venetian blind assembly 104.

The embodiment of the window blind assembly depicted in FIG. 12 is identified generally by the numeral 104*a*. It will be noted that the window blind assembly 104*a* is substantially identical to the window blind assembly 104 of FIG. 11 but is provided with tilt control discs 50*f* and 50*g* having stop surfaces 58*f* and 58*g* at different angular positions relative to the linear edges 56*f* and 56*g* of the apertures 54*d* and 54*g* therein. Consequently, the tilt control discs 50*f* and 50*g* will achieve a substantially greater range of rotational movement of the tilt control rod 106 with a correspondingly great range of rotational adjustments of the slats in the window blind assembly 104*a*.

In summary, a tilt control assembly for window blinds is provided. The tilt control assembly includes a noncircular tilt control rod which is rotatably mounted in a channel having a stop structure nonrotatably disposed therein. A pair of tilt control discs are nonrotatably mounted on the tilt control rod such that the tilt control rod and the tilt control discs rotate in unison. Each tilt control disc includes one stop surface nontangentially aligned thereto and dimensioned to contact the stop structure of a bracket engaged in the channel at a selected point during the rotation of the tilt control rod. The stop surfaces of the discs are disposed in opposed relationship to one another and are angularly separated from one another to positively control the ranges of rotational movement of the tilt control rod. The tilt control assembly preferably is formed by first providing a plurality of identical blank discs having nontangentially aligned stop surfaces at an outer peripheral portion thereon and having substantially continuous central portions. The mounting apertures subsequently are stamped through the blanks of the tilt control discs, with the angular alignment of the noncircular mounting apertures being selected to achieve a specified range of tilt for the blinds. The noncircular mounting apertures preferably are stamp formed in a stamp press having a fixture means and/or a punch die that are rotatable relative to one another to accurately rotationally position the stop surface relative to the punch die.

While the invention has been described with respect to certain preferred embodiments, it is apparent that various changes can be made without departing from the scope of the invention. In particular, the channel, the mounting bracket and the tilt control rod all can have cross-sectional configurations that vary considerably from those depicted herein. The means of mounting the tilt control discs to the tilt control rod also can vary considerably from the particular embodiment depicted herein. Similarly, the configuration, the angular alignment and the dimensions of the stop surfaces can vary from those depicted and described above. The tilt control discs need not be placed in direct abutting face-to-face relationship with one another and may be spaced from one another along the tilt control rod. Furthermore, the manufacturing process may be altered such that the mounting apertures are initially formed in the blanks and the stop surfaces are subsequently stamped therein at a specified angular alignment to the mounting apertures.

I claim:

1. A tilt control assembly for window blinds comprising:

a elongated channel;

a tilt control rod rotatably mounted in the channel;

first and second tilt control discs having external peripheries with stop surfaces thereon, said tilt control discs being in operative association with each other in said channel and each disc including a mounting aperture for achieving nonrotatable mounting of the tilt control discs on the tilt control rod, the tilt control discs being disposed such that the stop surfaces of said first and second tilt control disc are angularly separated from one another by a selected amount; and stop bracket means lockingly engaged in the channel for engaging the stop surfaces of tilt control discs at selected rotational positions of the tilt control rod.

2. A tilt control assembly as in claim 1 wherein the tilt control rod has a noncircular cross-sectional configuration, and wherein the mounting aperture of each of said tilt control discs has a noncircular configuration conforming to the cross-sectional configuration of the tilt control rod.

3. A tilt control assembly as in claim 1 wherein the mounting aperture of each of the tilt control discs includes at least one noncircular edge, said noncircular edges of the first and second tilt control discs being aligned at specified angles to the respective stop surfaces thereof.

4. A tilt control assembly as in claim 3 wherein the angular alignment of the noncircular edge of the first tilt control disc to the stop surface thereof is different from the angular alignment of the noncircular edge of the second tilt control disc to the stop surface thereof.

5. A tilt control assembly as in claim 1 wherein the stop bracket means includes a pivoting edge for pivotal movement against a portion of the elongated channel, a ramp edge spaced from the pivoting edge for generating deflection in a portion of the elongated channel and a locking edge in proximity to the ramp edge for locking engagement with the channel, whereby the stop bracket means can be pivoted into locking engagement with the channel at a selected longitudinal position therealong.

6. A tilt control assembly for window blinds comprising:

a elongated channel;

a tilt control rod rotatably mounted in the channel;

first and second tilt control discs having external peripheries with stop surfaces thereon, each said tilt control disc including a mounting aperture for achieving nonrotatable mounting of the tilt control discs on the tilt control rod, the tilt control discs being disposed such that the stop surfaces of said first and second tilt control discs are angularly separated from one another by a selected amount;

a stop bracket lockingly engaged in the channel to engage the stop surfaces of the tilt control disc at selected rotational positions of the tilt control rod;

wherein the bracket includes a pivoting edge for pivotal movement against a portion of the elongated channel, a ramp edge spaced from the pivoting edge for generating deflection in a portion of the elongated channel and a locking edge in proximity to the ramp edge for locking engagement with the channel, whereby the stop bracket can be pivoted into locking engagement with the channel at a selected longitudinal position therealong; and wherein the bracket includes a base wall and a pair of spaced apart end walls, the first and second tilt control discs being disposed intermediate the end walls of the bracket, whereby the end walls of the bracket limit longitudinal movement of the tilt control discs along the tilt control rod.

7. A tilt control assembly as in claim 6 wherein the base wall of the stop bracket includes a stop portion formed therein for engaging the respective stop surfaces of the tilt control discs.

8. A system of components for forming a tilt control assembly for a window blind, said system comprising:

an elongated channel;

a tilt control rod of noncircular cross section rotatably mounted in the channel;

a stop bracket engageable with the channel at a selected longitudinal position therealong, said stop bracket including at least one stop wall disposed to be in proximity to the tilt control rod upon engagement of the stop bracket in the channel; and a plurality of sets of pairs of tilt control discs, each said pair of tilt control discs including a noncircular mounting aperture extending therethrough and conforming to the noncircular cross-sectional shape of the tilt control rod and a stop surface at a peripheral location thereon, said stop surfaces of a pair of said tilt control discs being disposed to engage the stop wall of the stop bracket upon mounting the pair of tilt control discs on the tilt control rod and upon engaging the bracket in the channel, the stop surface of each of the pair of tilt control discs defining a selected angular alignment to the noncircular mounting aperture thereof, the angular alignment between the stop surface and the mounting aperture of each tilt control disc in each said pair of tilt control discs being substantially equal, but the angular alignment of the pair of tilt control discs in one set being different from the angular alignment of the pairs of tilt control discs in the other sets, whereby the system of components is assembled by mounting a selected pair of the tilt control discs to the tilt control rod and lockingly engaging the stop bracket in the channel in proximity to the selected pair of tilt control discs.

* * * * *